US009120346B2

(12) United States Patent
Pigg, Jr. et al.

(10) Patent No.: US 9,120,346 B2
(45) Date of Patent: Sep. 1, 2015

(54) METHOD FOR PROVIDING A SPINE LABEL POCKET ON A BINDING COVER

(71) Applicant: Samsill Corporation, Fort Worth, TX (US)

(72) Inventors: John William Pigg, Jr., Cleburne, TX (US); James Robert Schultz, Jr., Fort Worth, TX (US)

(73) Assignee: Samsill Corporation, Fort Worth, TX (US)

( * ) Notice: Subject to any disclaimer, the term of this patent is extended or adjusted under 35 U.S.C. 154(b) by 426 days.

(21) Appl. No.: 13/664,591

(22) Filed: Oct. 31, 2012

(65) Prior Publication Data

US 2013/0061447 A1 Mar. 14, 2013

Related U.S. Application Data

(63) Continuation-in-part of application No. 13/249,946, filed on Sep. 30, 2011, now Pat. No. 8,647,008.

(60) Provisional application No. 61/388,312, filed on Sep. 30, 2010.

(51) Int. Cl.
*B42F 13/00* (2006.01)
*B42C 7/00* (2006.01)

(52) U.S. Cl.
CPC ..... *B42F 13/006* (2013.01); *B42C 7/002* (2013.01); *B42F 13/002* (2013.01); *B42F 13/0006* (2013.01); *Y10T 29/49826* (2015.01)

(58) Field of Classification Search
CPC ..... B42F 13/0006
USPC ..... 412/3, 17; 402/73–74, 76–77
See application file for complete search history.

(56) References Cited

U.S. PATENT DOCUMENTS

| | | | | |
|---|---|---|---|---|
| 1,370,265 | A * | 3/1921 | Bardenheuer | 402/75 |
| 1,673,670 | A * | 6/1928 | Finley | 402/75 |
| 3,206,225 | A * | 9/1965 | Oleson | 412/3 |
| 5,330,279 | A | 7/1994 | Ruble | |
| 5,711,627 | A * | 1/1998 | Chapman | 402/73 |
| 5,720,564 | A | 2/1998 | Winzen | |
| 5,876,143 | A * | 3/1999 | Ong | 412/17 |
| 6,761,498 | B1 | 7/2004 | Harris, Jr. et al. | |
| 6,902,340 | B2 | 6/2005 | Harris, Jr. et al. | |
| 2008/0211220 | A1 * | 9/2008 | Boxer | 281/21.1 |
| 2012/0080876 | A1 * | 4/2012 | Bowers et al. | 412/3 |
| 2014/0126950 | A1 * | 5/2014 | Loree et al. | 402/70 |

* cited by examiner

*Primary Examiner* — Kyle Grabowski
(74) *Attorney, Agent, or Firm* — Whitaker Chalk Swindle & Schwarz PLLC; Stephen S. Mosher

(57) ABSTRACT

A binding cover having a transparent overlay cover disposed over and around the spine of the binding is configured to provide a label pocket on the spine portion of the binding cover wherein a label may be inserted easily without tools or rigid label material. In several embodiments the label pocket provides a fixed label space. In another embodiment the label pocket opens along the spine when the binding cover is opened, and returns to a closed position when closed, thereby retaining a label inserted therein. In other embodiments, methods for forming the label pocket are provided.

19 Claims, 13 Drawing Sheets

METHOD FOR PROVIDING A SPINE LABEL POCKET ON A BINDING COVER

CROSS-REFERENCE TO RELATED APPLICATION

The present application is a Continuation-In-Part of U.S. patent application Ser. No. 13/249,946, filed Sep. 30, 2011 and entitled "Spine Label Pocket for a Binder Cover;" and further claims priority from U.S. Provisional Patent Application Ser. No. 61/388,312, filed Sep. 30, 2010, entitled "Label Pocket for Binder Spine," by the same inventors.

BACKGROUND OF THE INVENTION

1. Field of the Invention

The present invention generally relates to document binders and book bindings and labeling features thereof, and more particularly to a method for providing label pockets in binding covers.

2. Background of the Invention and Description of the Prior Art

Binding covers for bound materials and documents are available for many applications in a variety of styles and construction. Among such applications are binding covers for binding and storing documents and the like in reusable binders. Many such binders, such as the ubiquitous ring binder include a construction feature for inserting a label in a pocket provided on the cover or spine of the binder cover. The pocket is typically provided by bonding the edges of a transparent plastic layer to the surface of the binder cover or spine along an edge or seam, leaving an upper edge of the transparent layer unbonded and open to allow inserting a label into the pocket. However, such binder covers heretofore have the disadvantage in that, because of the type of construction that provides a pocket having close-fitting panels, it is typically very difficult to insert or remove a label from the pocket easily and without bending or other damage to the label or to the pocket. Two of the reasons for this disadvantage are that there is insufficient space allowed between the transparent layer and the surface of the binder cover, and friction that exists between the facing inside surfaces of the pocket that enhances the difficulty of inserting or removing a label. In the case of thermoplastic materials used for covering the cover boards and providing the transparent overlay, static electricity may present a further impediment to insertion of a label into the pocket.

In one specific example, ring binders are widely used and come in a variety of types (reference, storage, view), sizes (to accommodate thicknesses of 0.5" to 6") and utilize different cover materials (polyvinylchloride or "PVC," polypropylene or "PP," paper, cloth fabric, etc.). The most popular binders on the market are called view or insertable binders. They have a clear overlay over the opaque material allowing for the insertion of printed material in the front, back and spine for customization. The biggest problem since the invention of the view/insertable binder has been getting the label into the spine/hub section of the binder in a timely fashion without damaging the insert or the binder.

A number of attempts exist in the prior art to solve this problem. For example, U.S. Pat. No. 5,711,627 issued to Chapman discloses a "Flexible Spine Binder With Window Pocket and Spine Stiffener Insert," which provides a stiff insert that is required to stiffen the spine of the binder having a flexible spine. The stiffener may also be used as a label. Thus, the stiffener is required both to stiffen the spine and to provide a label that, being of a rigid material enables easier insertion or removal from the pocket. Even if a spine label is not needed as both a tool and a label, the stiffener is required to provide sufficient structural form for the binder. U.S. Pat. No. 5,720,564 issued to Winzen discloses a "Binder With Label Holder" that attaches a transparent sheet attached to a binder cover along seams spaced well away from the vicinity of the hinges connecting the front and rear covers to the spine, thus enabling a conventional size sheet of paper to be inserted and wrapped around the spine within the holder. One disadvantage of this configuration is that the size of paper required is far larger than needed for a label, leading to waste. Another disadvantage is that if the label is made smaller it is likely to fall out or shift position when the binder cover is opened because the clear layer is then allowed to be displaced well away from the binder cover boards.

U.S. Pat. Nos. 6,761,498 and 6,902,340 issued to Harris, Jr., et al. teaches forming the spine board of a binder cover with a depressed area within its borders—i.e., the spine thickness is reduced in the central area of the spine—to provide space for the thickness of a label. This configuration adds manufacturing cost to provide the spine board having a central region thinner than its borders. U.S. Pat. No. 6,267,412 issued to Henderson discloses a "Window Pocket Insertion and Removal Device," which is a tool with special features to enable inserting and removing a spine label from the spine pocket of a conventional binder. The requirement for a tool to insert and remove a spine label is superfluous if such a tool becomes unnecessary in an improved design that enables label installation and removal without a tool.

None of the foregoing examples provide a binder cover having a label pocket design that effectively permits easy insertion or removal of a label without the use of tools and which minimizes the possibility of damage to the label pocket or the label during insertion or removal.

SUMMARY OF THE INVENTION

Accordingly a binding cover for a book is provided comprising a hinged cover board having front and back panels each joined respectively via a first or second hinge to a spine panel disposed between corresponding edges of said front and back panels, and a transparent overlay disposed over respective outer surfaces of the spine panel and the front and back panels and attached to each the front and back panel along first and second seams, each the first and second seam disposed in the vicinity of the hinges and a predetermined spacing from and parallel to a proximate the respective hinge joining a the front or back panel to the spine panel, thereby forming a label pocket between the transparent overlay and the spine panel.

In another aspect the first and second seams are disposed a first predetermined spacing from and on the near side of the first and second hinges from the label pocket and the overlay between the first and second seams is spaced a second predetermined spacing from the spine panel.

In another aspect the first and second seams are disposed a first predetermined spacing from and on the opposite side of the first and second hinges from the label pocket such that the overlay is disposed against the spine panel when the binding cover is closed, wherein the overlay opens to form the label pocket and receive a label when either of the front and back panels of the binding cover are opened.

In another aspect the first and second seams are disposed coincident with the first and second hinges respectively in combination with the overlay between the first and second seams spaced a predetermined spacing away from the spine panel.

In another embodiment a method is disclosed for providing a label pocket on the spine of a book cover having front and back cover panels hinged along first and second hinges to a spine panel, comprising the steps of: placing a transparent overlay sheet around an outer surface of the spine panel and extending the overlay to outer surfaces of the front and back panels to at least a position spaced beyond the hinges from the spine panel; inserting a spacer between the outer surface of the spine panel and an inner surface of the overlay, the spacer being narrower than a width of the spine panel; attaching the overlay to the respective front and back cover panels or to the spine panel, adjacent the hinges along a seam parallel with the hinges; and removing the spacer from between the spine and the overlay following the attaching step.

In an alternate embodiment, a method of forming a spine panel label pocket in a binder cover having a clear overlay covering the outer surfaces of said binder cover is disclosed comprising the steps of: inserting retractable first and second shuttle inserts, one each from opposite top and bottom ends of a spine panel of the binder cover, between the spine panel and the overlay; applying a temporary seal along first and second hinge lines disposed on either side of the spine panel, thereby tacking the overlay to the binder cover along the first and second hinges; and withdrawing the shuttle inserts from the binder cover. Following the withdrawing step, the method includes applying a permanent seal along the first and second hinge lines disposed on either side of the spine panel, thereby securing the overlay to the binder cover and forming a label pocket between the overlay and the spine panel.

DETAILED DESCRIPTION OF THE INVENTION

Figure 1:
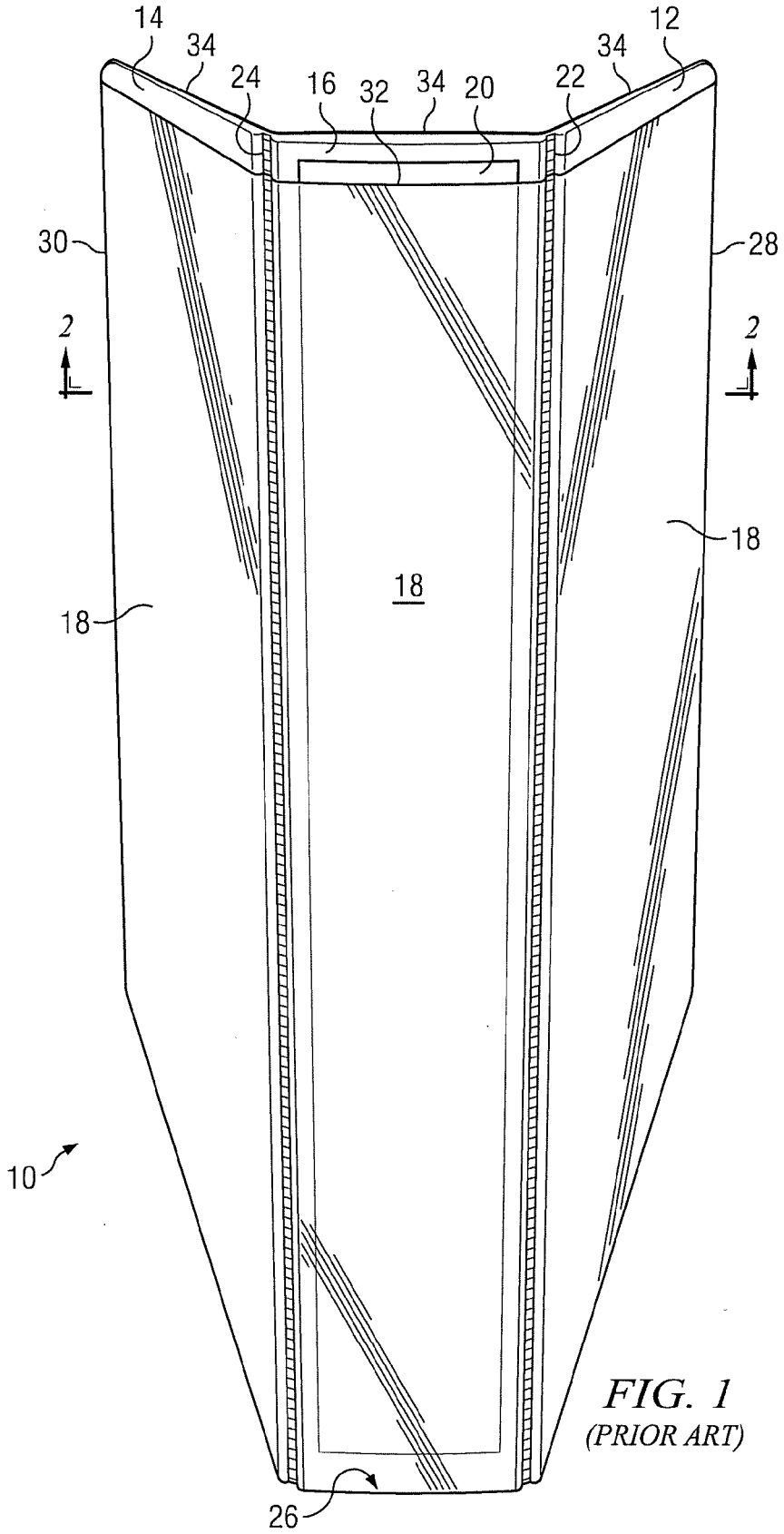
FIG. 1 (PRIOR ART)
FIG. 1 illustrates a prior art binder cover having a clear overlay secured against the spine panel at the cover hinges to provide a spine label pocket.

The invention in its several embodiments is described with reference to the following figures illustrating essential features of the invention to provide a binder cover apparatus—and a method for fabricating it—that is equipped with a spine label pocket configured for repeated easy insertion and removal of a spine label without damage to the label or the spine label pocket space, and without the use of tools or other aids. In a preferred embodiment the spine label pocket is pre-formed in a transparent overlay attached to the binder cover so that it has a defined space provided for the label whether the binder cover is closed or opened. In another embodiment (seals disposed in the vicinity of and inside the hinges) the spine label pocket is also pre-formed but has an additional pair of seals along the label pocket in the vicinity of the hinges to better define the pocket and permit the use of certain materials for the clear overlay. In yet another embodiment (seals disposed in the vicinity of and outside the hinges) the clear overlay is attached just outside but in the vicinity of the hinges. In this embodiment the spine label may be inserted or removed by opening the binder cover sufficiently to cause the label pocket to bulge outward, thus opening the pocket to expand the space within the pocket, wherein the label may be easily inserted or removed. Closing the binder cover draws the transparent layer of the spine against the label and the spine of the binder cover to secure the label within the pocket. Removal is simply the reverse of these steps: open the binder cover to open the pocket and pull the label insert from the pocket. A fourth embodiment includes a method of fabricating a binder cover to provide the preferred embodiment. The method is readily adaptable to all described embodiments because of the structural similarities among them. Persons skilled in the art will realize that all illustrated embodiments and other equivalents may be fabricated using variations of the same method as described herein.

In an example of a use of the present invention, ring binders may be provided having a transparent plastic cover sheet overlaid and bonded to the binder cover along the side and bottom edges leaving the upper edge at the margin open. This configuration creates a pocket for inserting a title sheet for the front cover or a title label for inserting in a spine pocket along the spine or hub of the binder. The spine pocket provides for quick customization of the binder cover by allowing easy insertion of labels in the spine pocket between the transparent and opaque plastic cover materials. Distinctive features of the present invention are provided by revisions to the methods of manufacturing that provide a spine label insert pocket for a binding cover with substantially improved usability and freedom from damage to the label or the binder cover. The invention may be readily adapted to other binding cover applications such as book or document covers and the like, including without limitation a loose-leaf binder, a ring binder, a document binder, a case-bound book, a case-bound document, a hard back book, a book cover, a scrapbook, an album, a photo album, and a bound portfolio.

Further details of the invention are included in the following description with reference to the drawings and the appended claims to the invention. In the figures to be described, structures identified with the same reference numbers in more than one drawing are understood to refer to the same structural feature. The detailed description includes some dimensional information that is intended to provide examples of preferred dimensions or ranges thereof but to not be limiting as to the concepts embodied in the invention. While the embodiments of the present invention to be described contain some of the same component parts or features, the invention will be understood to reside in the complete combination of features illustrated and described for each exemplary embodiment in the following detailed description.

FIG. 1 illustrates a prior art binder cover having a clear overlay secured against the spine panel at the cover hinges to provide a spine label pocket. While a pocket is provided by the illustrated cover, it is difficult to use because of the lack of sufficient space for the label to be easily inserted or removed. The friction, or in some cases the static electricity that typically exists between the inside facing surfaces of the pocket often enhances the difficulty, resulting in damage to the pocket or the label or both in attempts to insert or remove the label. In the figure, the binder cover 10 includes a front cover 12, a back cover 14, and a spine or spine panel 16 joined to the respective front and back covers along hinges 22 and 24. Hinge 22 joins the front cover (or panel) 12 to the spine 16. Hinge 24 joins the back cover (or panel) 14 to the spine 16. The front and back covers 12, 14 and spine 16 may be clad on at least their outer surfaces in a plastic material such as polyvinylchloride ("PVC"), polypropylene ("PP"), fabric, or paper, for example. Wrapped around and against the outer surfaces of the front 12 and back 14 covers and the spine 16 is a layer or sheet—overlay 18—of clear plastic material such as PVC or PP. The overlay 18 may be secured to the front and back covers 12, 14 and spine 16 along the lower 26 and outer side 28, 30 edges of the respective panels. The upper edge 32 of the overlay 18 is typically unsecured and positioned somewhat away from (below in the view of FIG. 1) the upper edges 34 of the front 12 and back 14 covers and spine 16. Also depicted inserted into the label space between the spine 16 and the overlay 18 is a label 20, a portion of which is exposed above the upper edge 32 of the overlay 18, shown without indicia. Note that the space between the upper edge 32 of the overlay 32 and the upper edges 34 of the front and back covers and spine 16 may be called the margin of the binder cover in this description.

Figure 2:
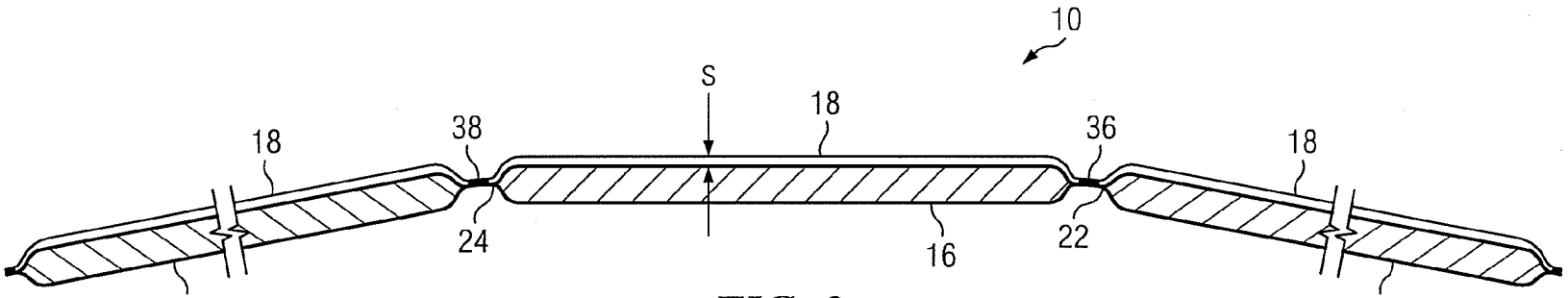
FIG. 2 (PRIOR ART)
FIG. 2 illustrates a cross section or end view of the prior art binder cover of FIG. 1 showing the clear overlay disposed close to the spine of the binding cover.

FIG. 2 illustrates a cross section or end view of the prior art binder cover 10 of FIG. 1 shown in a wide open disposition and looking upward in the view shown in FIG. 1 toward the top edge of the cover 10. The front 12 and back 14 covers and the spine panel 16 are clad with the clear overlay 18 on the outer surfaces thereof. The clear overlay 18 is additionally secured to the first hinges 22, 24 joining the front 12 and back 14 covers to the spine panel 16 by a seal 36, 38 disposed respectively along the length of the hinges 22, 24. The seals 36, 38 are indicated by the rectangular dots at the locations of the hinges 22, 24. It will be noted that FIG. 2 shows the clear overlay 18 disposed close to the spine 16 of the binder cover 10 as indicated by the dimension "s" (40). The dimension "s" may vary from zero millimeters through typically some fraction of a millimeter up to approximately one millimeter. In general, little or no space is provided in this prior art example because the overlay 18 is disposed snugly against the spine 16, making it difficult to insert a label 20 of any thickness because of the tight clearance, the effects of friction and static electricity, etc. It is especially difficult to feed a thin, full-length label into this minimal space, without undue stress on the hinge seals or damage to the label 20.

Figure 3:
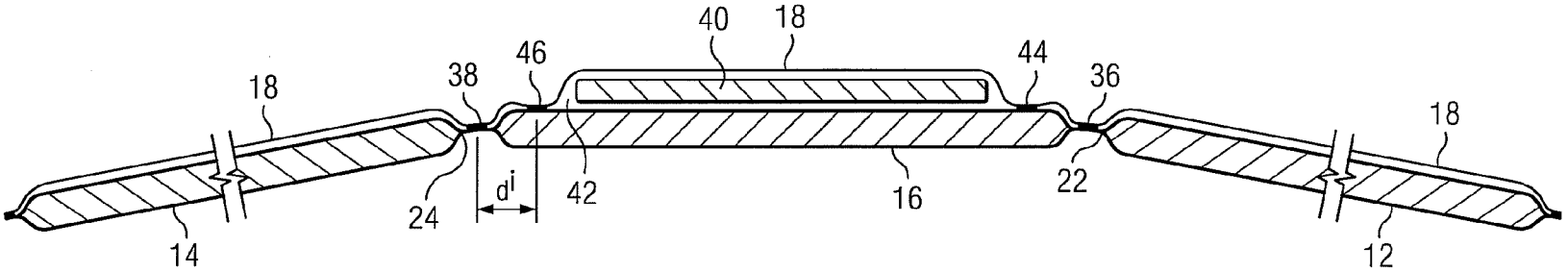
FIG. 3 illustrates an end view of a first embodiment of a binder cover according to the present invention, to provide a fixed spine label pocket.

FIG. 3 illustrates an end view of a first embodiment of a binder cover according to the present invention, that provides a spine label pocket to overcome the problems noted herein above. The view in FIG. 3 depicts a cross section of the cover assembly 49 during fabrication wherein a spacer insert 40 having a predetermined thickness is placed against the spine 16 of the cover assembly 49. The spacer insert 40 used for forming the defined label space of each of the embodiments described herein may have a thickness in millimeters of 0.2 mm to 2.0 mm in typical applications, but may vary beyond this range of values in certain specific applications. During fabrication, when the overlay material 18 is placed upon the outer surfaces of the cover assembly 49 formed by the front 12, back 14 and spine 16 panels joined at first 22 and second 24 hinges, first and second bonding steps providing a sealing or welding of the materials take place to secure the overlay material 18 to the cover assembly 49 at the locations shown. In one of the sealing steps a bond—a seal or weld or seam—may be applied in a variety of methods well-known in the art to the combination of the cover assembly 49 and the overlay material 18 at each of the locations of the first and second hinges 22, 24 to create first and second compound seals 36, 38 respectively. In the other of the bonding or sealing steps, a second seal, weld, or seam is applied to the combination of the cover assembly 49 and the overlay material at each of the locations indicated in FIG. 3 by the third and fourth seals 44, 46 respectively. The third 44 and fourth 46 seals capture the spacer 40 between them, forming a defined label space 42. It will be understood by persons skilled in the art that the sealing methods may include but not be limited to application of heat, pressure, adhesives, stitching and other processes suitable for the manufacturing required.

Figure 4:
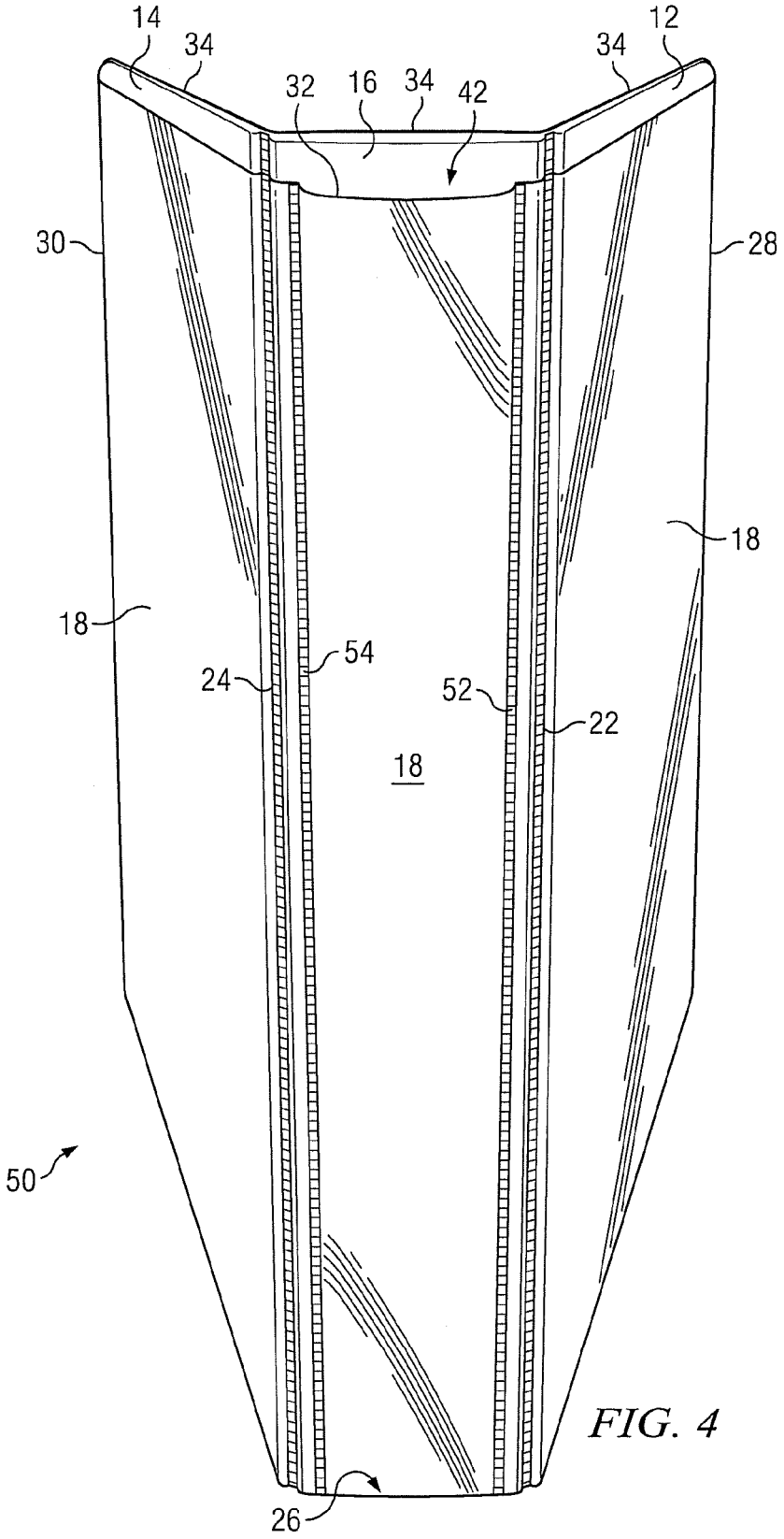
FIG. 4 illustrates a binder cover having a clear overlay according to the first embodiment of the present invention illustrated in FIG. 3.

Near the end of the fabrication process, after the sealing steps are completed, the spacer 40 may be removed, producing a finished binder cover 50 having a "built-in" label space 42 formed along the spine 16, as shown in FIG. 4 to be described. Alternatively, the spacer 40 may also be left in place during shipment and removed before the binder cover 50 is placed in use. It should be noted that the third 44 and fourth 46 seals are disposed in the vicinity of the hinges 22, 24 but spaced by a predetermined distance d' (for the distance between the inside of the region between the first and second hinges 22, 24 and the proximate respective edge of the spacer 40). This predetermined distance d' may be preferably in the range of 1.0 to 5.0 mm, but may vary depending on the particular type or application of the binder cover 50. In use, the spacer 40 may be moved to permit insertion of the spine label as desired. Use of the binder cover 50 and flexing of it to open or close it will not distort or otherwise affect the spine label pocket 42. The space created during fabrication is thus preserved for use, allowing insertion and removal of a label 20, even ones made of relatively soft, non-rigid materials, with tools or risk of damage to the label itself.

FIG. 4 illustrates a binder cover 50 having a clear overlay according to the first embodiment according to the present invention illustrated in FIG. 3, shown with the spacer insert 40 removed and depicted in an upright perspective view looking toward the spine of the binder cover 50. The front 12 and back 14 cover panels or boards are joined to the spine panel 16 along the first 22 and second 24 hinges respectively to form the basic binder cover. A transparent overlay 18 is shown attached to the binder cover 50 along the bottom edge 26 and the first 28 and second edges 30. The transparent overlay 18 extends toward the top edge 34 of the cover panels 12, 14, and 16 such that the upper-most edge 32 of the transparent overlay 18 is disposed at a point a few millimeters below the edge 34 along the upper margin (the space between the edges 32 and 34). The upper edge 32 of the overlay 18 is not attached to the cover panels 12, 14 or to the spine panel 16 in the margin to allow paper inserts to be inserted between the surface of the cover panels 12, 14, 16 and the transparent overlay 18. As described in FIG. 3, the binder cover 50 is fabricated to form a defined label space 42 to enable insertion of a label (not shown, but see FIG. 1 for an example of a label 20 shown in dashed lines) without impediment and without requiring the use of any kind of tool to facilitate inserting the label 20 in the defined label space 42. Also as described in FIG. 3, the label space 42 is given definition by the third 52 and fourth 54 seals, welds, or seams disposed between the hinges 22, 24 and the edges of the spacer insert 40 before it was removed, thus forming the binder cover 50 as shown.

FIG. 5 illustrates in a sequence of views A through F a process for producing the spine label pocket of the first embodiment of FIGS. 3 and 4. In this embodiment a piece of spacing material and additional seals will be shown as they may be used during the manufacturing process. The view in FIG. 5A shows a sheet of opaque cover material 60 cut to size and spread over the cover panels 12, 14 and spine panel 16. The opaque cover material may be made of polyvinyl chloride or polypropylene sheet material having a thickness suitable for the application. The positions of the adjacent edges of the cover panels 12, 14 and spine panel 16 underneath the opaque cover material 60 are shown in dashed lines in FIG. 5A, but not shown in FIGS. 5B through 5F for clarity of the process. In FIG. 5A the edges of the cover panels 12, 14 and the spine panel 16 that coincide with the edges of the opaque cover material (top, bottom, and left and right sides in the figure) are also not shown to preserve the clarity of the process being described. In FIG. 5B, a spacer 40 is placed over the opaque cover material 60 directly over and centered between the positions where the hinges 22, 24 will be formed with respect to the spine panel 16. The spacer 40 may be approximately the same length as the spine panel 16 and have a thickness that may vary between 0.020 and 0.125 inch (or, 0.5 to 3.0 mm). The spacer 40 (or alternately, spacer insert 40) may be formed from a variety of materials including paper, plastic, wood, or a composite of these or other suitable materials. The spacer insert 40 may be shaped and dimensioned to suit particular applications. For example, some binder covers may not be substantially flat as shown in the embodiments illustrated herein, but may have a round convex or concave profile requiring a different configuration of spacer insert 40 to provide a suitable spine label pocket. Further, while the spacer 40 is normally removed following completion of the manufacturing process, it may be retained in the spine pocket 42 (FIGS. 3, 4, and 5F), 62 (FIGS. 6 and 7), or 72 (FIGS. 8 and 9) as packaged for shipment and removed by the end user when the binder cover is placed into service.

Figure 5A:
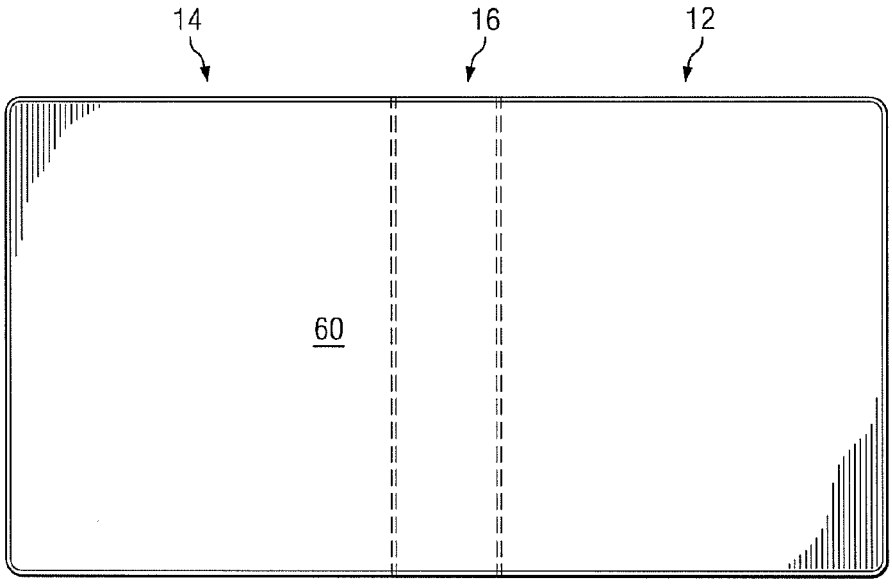
FIG. 5 illustrates in a sequence of views A through F a process for producing the spine label pocket of the first embodiment of FIGS. 3 and 4.
Figure 5B:
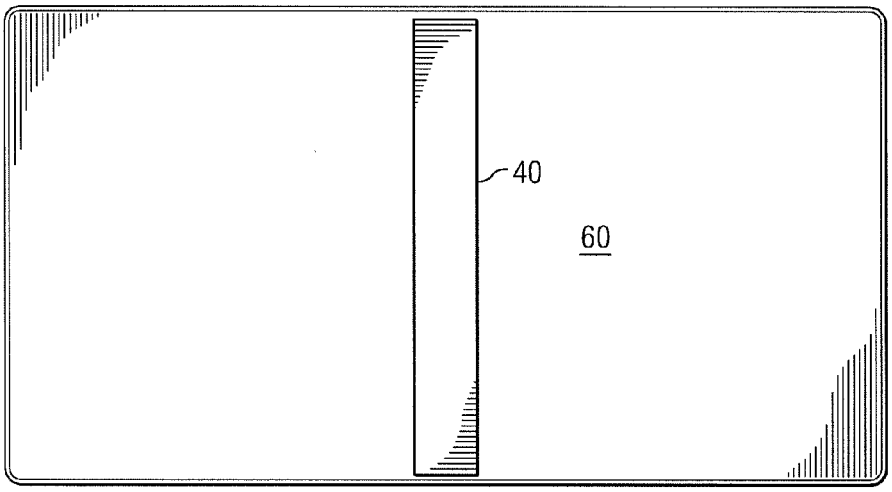
Figure 5C:
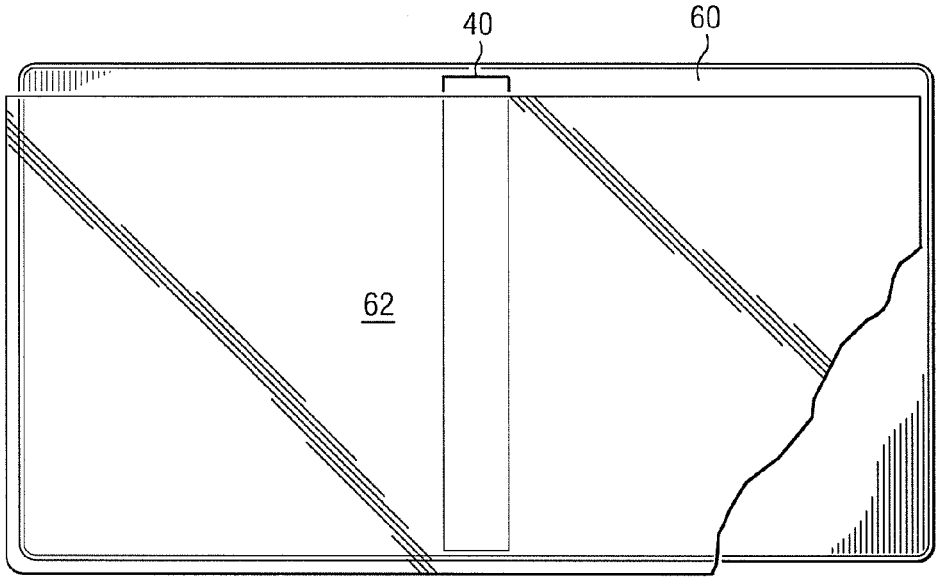
Figure 5D:
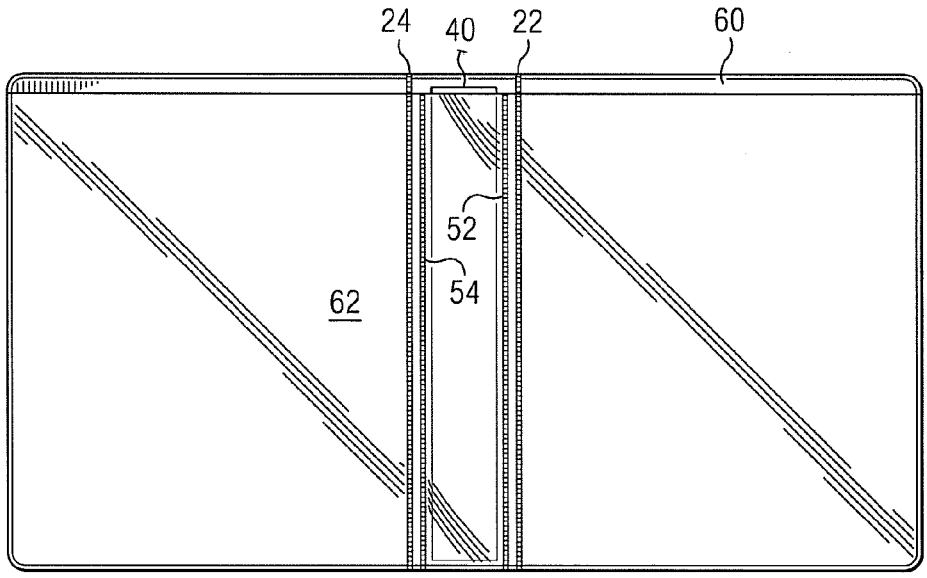
Figure 5E:
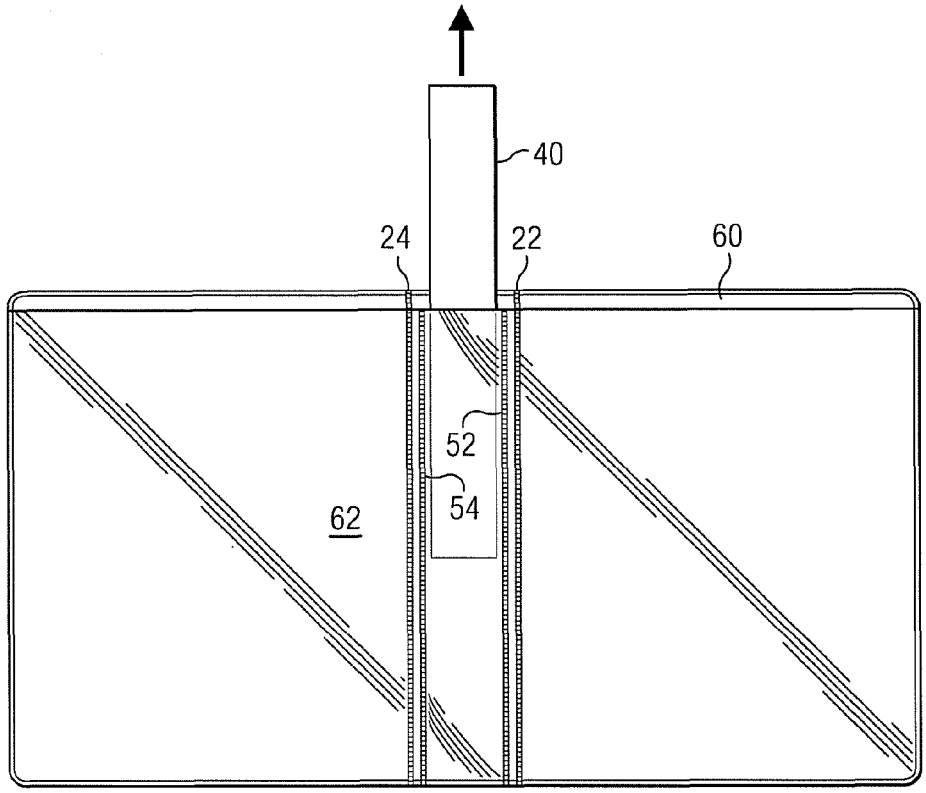
Figure 5F:
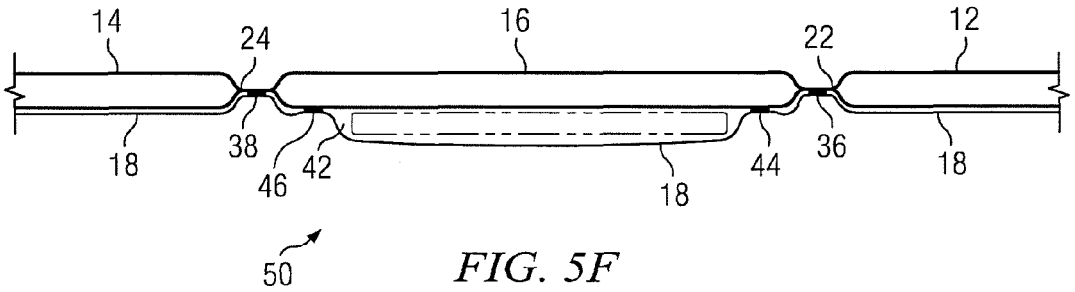

Continuing with FIG. 5C, a layer of transparent plastic 62 having a thickness in the range from 0.05 mm to approximately 0.30 mm is placed over the assembled spacer insert 40 and opaque cover layer 60. The transparent plastic layer 62 will become the transparent overlay 18 in the finished binder cover. Next, as shown in FIG. 5D both front 12 and back 14 cover panels are bonded or sealed along the outside (right 28 and left 30 edges as shown in FIG. 4) and bottom 26 edges of the front 12 and back 14 cover panels and along the hinge joints 22, 24 between the cover boards and spine panel 16. The process for manufacturing the present invention then adds a step by applying a bar seal, weld, seam, or other bond 52, 54 between the position of the spacer 40 on each side thereof and the proximate (nearby) hinge joint at the locations 22, 24. After all bonding or sealing is complete the spacer 40 is removed as depicted in FIG. 5E to leave a permanent space (label space or spine pocket 42, as shown in FIG. 4) between the transparent overlay 62 and the spine panel 16. This label space 42 also depicted in FIG. 5F, in a view looking downward from a position above the binder cover 50 with both front 12 and back 14 covers opened wide, allows the easy insertion of a label into it. Note that the position of the spacer 40 is indicated by dashed lines in FIG. 5F. This method is superior to other methods on the market because it saves time, prevents damage to the components of the binder cover 50 and doesn't require any additional tools. It also makes for easy removal of a spine label allowing for the ring binder having the binder cover 50 to be reused.

Figure 6:
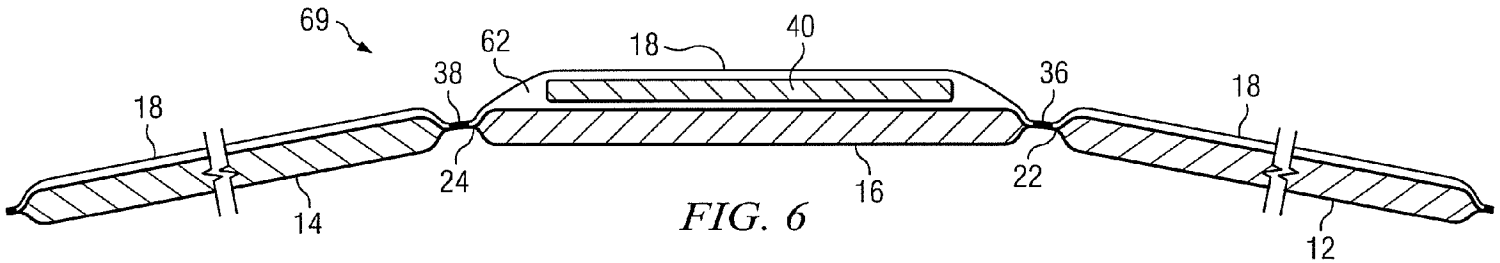
FIG. 6 illustrates an end view of a second embodiment of a binder cover according to the present invention to provide a fixed spine label pocket.
Figure 7:
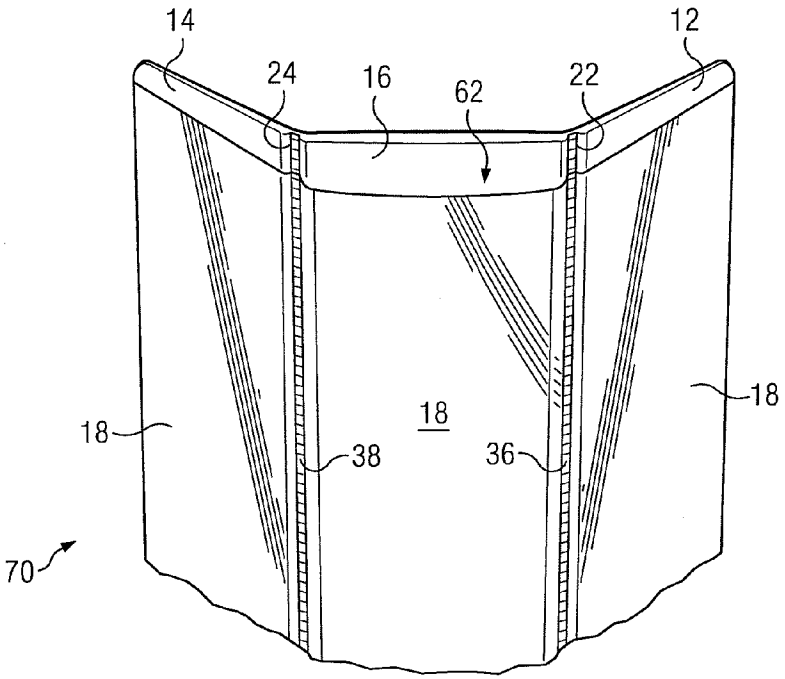
FIG. 7 illustrates a binder cover having a clear overlay according to the second embodiment of the present invention illustrated in FIG. 6.

FIG. 6 illustrates an end view of a second embodiment of a binder cover 69 according to the present invention to provide a fixed spine label pocket 62. The second embodiment is similar to the first embodiment described in FIGS. 3, 4, and 5A through F except that it omits the second pairs of seals, welds, or seams 52, 54 in a fabrication process that employs the steps illustrated in FIGS. 5A, 5B, 5C, and 5E in sequence, resulting in the binder cover 70 depicted in FIG. 7. The perspectives of the binder cover 69 in FIG. 6 and the finished binder cover 70 in FIG. 7 are similar to the perspectives shown in FIGS. 3 and 4 respectively, except that the finished binder cover 70 is illustrated in truncated form with its lower extremity omitted. The second embodiment of FIGS. 6 and 7 provides a label pocket 62 defined by boundaries along or coincident with the hinged joints 22, 24 instead of along the separate seals, welds, or seams 52, 54 as shown in FIGS. 3 and 4. This label pocket 62 provides a little more space for a label and is less expensive to manufacture.

Figure 8:
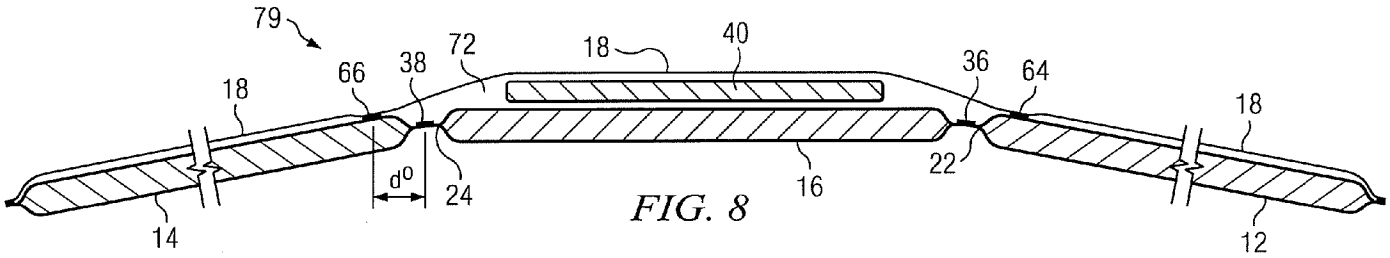
FIG. 8 illustrates an end view of a third embodiment of a binder cover according to the present invention to provide a spine label pocket that opens when the binder cover is opened.

FIG. 8 illustrates an end view of a third embodiment of a binder cover 79 according to the present invention to provide a spine label pocket 72 that opens when the binder cover is opened. In this embodiment another bonding or sealing step is added during the manufacturing process, similar to that illustrated in FIGS. 5A through 5F, but the added bonds or seals are placed in a different location on the binder cover panels 12, 14 from the first embodiment. The first three steps of the fabrication process are the same is depicted in FIGS. 5A, 5B, and 5C. Then, in step 5D, the third embodiment is produced by placing the added seals, fifth seal 74 and sixth seal 76, on the opposite side of the hinges 22, 24 from the spine panel 16, i.e., outside the hinges 22, 24 but still in the vicinity thereof. It should be noted that the fifth 74 and sixth 76 seals are spaced by a predetermined distance $d^0$, the distance toward the outside of the region from the first and second hinges 22, 24). This predetermined distance $d^0$ may be preferably in the range of 1.0 to 5.0 mm, but may vary depending on the particular type or application of the binder cover 50.

Figure 9:
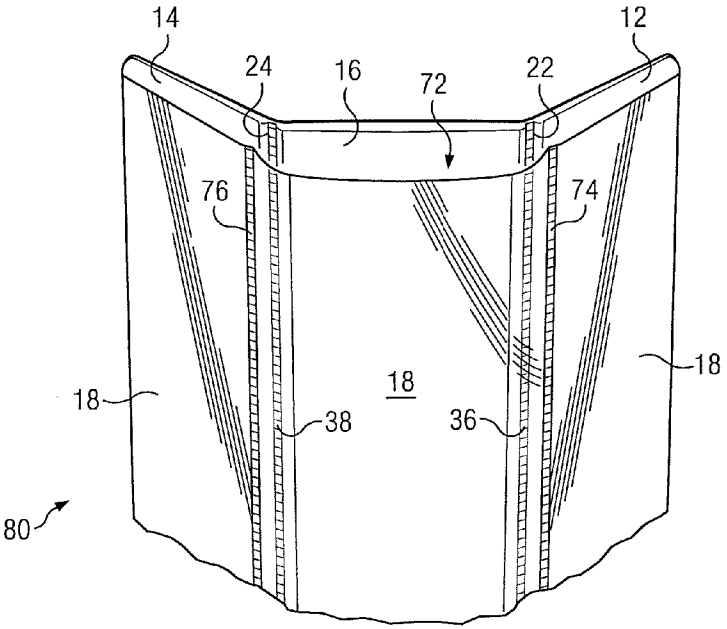
FIG. 9 illustrates a binder cover having a clear overlay according to the third embodiment of the present invention illustrated in FIG. 8.

This places the bonds between the transparent overlay 18 and the binder covers 12, 14—i.e., seals, welds, or seams 74, 76 on the surface of the front 12 and back 14 cover panels respectively. Next, when the seals 74, 76 are in place, the spacer 40 may be removed, as in Step 5E, leaving the finished binder cover 80 as shown in FIG. 9 with the spine label pocket 72. These extra seals 74, 76 disposed in the range of 1.0 to approximately 5.0 mm outside of the traditional binder hinge joint but still in the vicinity thereof provide additional width in the spine region between the transparent and opaque material when the binder cover 80 is opened. Additionally, when the binder cover 80 is closed, each of the second pair of seals 74, 76 move with the front and back cover panels 12, 14, i.e., they separate, and the extra space within the spine label pocket 72 is drawn against the surface of the spine 16, causing the transparent 18 and opaque layers to approach each other. This embodiment, in which the features of the first and second embodiment described herein are combined, thus provides more space for a label insert. Further, it will be appreciated that this third embodiment of the binder cover 80, which provides the spine label pocket 72, is formed differently and operates differently in use.

Illustrated in FIGS. 10 through 16 is yet another embodiment of the invention describing a method for forming a spine panel label pocket in a binder cover having a clear overlay covering the binder cover. The present method is well adapted to production on a continuous production line in one example of a facility suitable for automated production according to the method described herein. This type of production line or facility may be similar to that used for laminating sheets of polypropylene together to produce plastic bags, covering boards of thin material for other uses, etc. The process of manufacture begins with rolls of the polypropylene (or, in the alternative, polyvinyl chloride or PVC) sheet material or the equivalent used to form the cover fabric and clear overlay portions of the binder cover to be described. The sheet material may have a thickness of at least 0.05 mm and less than approximately 0.50 mm.

In the illustrated example, each inside cover fabric and outside cover fabric and clear overlay may be dispensed from separate rolls of bulk material into appropriate positions, one above the other (inside sheet on the bottom, and clear overlay on the top) as they are fed into the conveying apparatus to receive the front, back, and spine panel cover boards in the proper sequence before advancing to succeeding steps along the continuous production line. The polypropylene sheet may be provided in a variety of colors and thicknesses according to the particular binder cover to be fabricated. Other materials may be used, depending on the type of binder cover to be produced. For example, binder covers may be produced for a loose-leaf binder, a ring binder, a document binder, a case-bound book, a case-bound document, a hard back book, a book cover, a scrapbook, an album, a photo album, and a bound portfolio to name several examples.

The method, stated briefly, comprises four primary steps to create a spine label pocket. The process is described for the example of the continuous production line mentioned above. The spine panel spacers are inserted, one from each side of the production line at the appropriate point while the workflow is temporarily halted for the operations to be described that form the spine label pocket. The four primary steps are: inserting retractable first and second spine panel spacers ("spacers"), one each from opposite top and bottom ends of a spine panel of the binder cover, between the spine panel and the overlay; applying a fine line or tack seal (e.g., a temporary seal) along first and second hinge lines disposed on either side of the spine panel, thereby tacking the overlay to the binder cover along the first and second hinges; withdrawing the spacers from the binder cover; and applying a full width seal (e.g., a permanent seal) along the first and second hinges.

In an initial step preceding the inserting step, the binder cover is positioned opened flat with its inside face downward and with the spine panel in alignment with the spacers, which are disposed in a retracted state. Then, following the inserting step in the illustrated example, the overlay is nudged laterally from one side along one panel of the binder cover toward the spine panel, with the overlay 114 above the other panel of the binder cover held stationary, to slightly bulge the overlay material by a predetermined amount just above the spine panel and just before the fine line or tack seal is applied. In an additional step following the application of the full width seal along the first and second hinges, a full width seal is also applied along the bottom end of the spine panel at the edge of the binder cover to close the lower end of the spine label pocket. Persons skilled in the art will understand that the full width seal along the hinges and the edges of the binder cover may be applied in a single step. Further, the steps described herein are intended to illustrate the objective of each of the steps in the sequence, even though the actual process used to carry out one or more of the illustrated steps may vary. For example, the "nudging" step may be accomplished in a variety of ways by hand or automated processes. The individual steps will be described as depicted in FIGS. 10 through 16. These figures are not drawn to scale; rather they are drawn to depict the structure and the relationships thereof. Further, structures shown in FIGS. 10 through 16 bearing the same reference numbers are identical structural features or elements.

Figure 10:
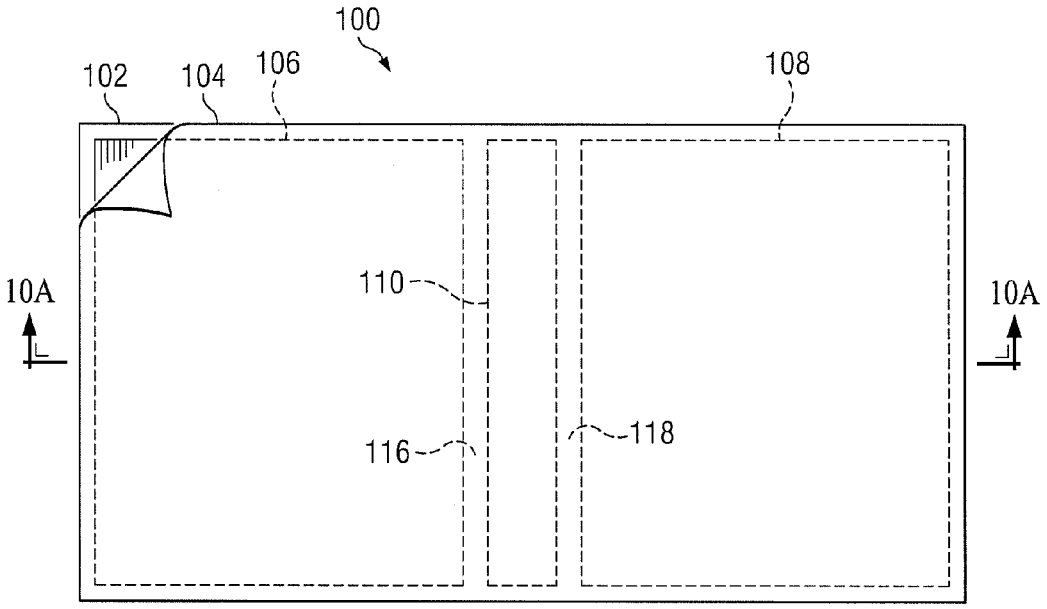
FIG. 10 illustrates a preparatory step in a method for providing a spine label pocket on the outer surface of the spine of a binder cover according to an alternate embodiment of the invention.

FIG. 10 illustrates a preparatory step in the method for providing a spine label pocket on the outer surface of the spine of a binder cover according to an alternate embodiment of the invention. Shown in FIG. 10 is the step of positioning front, spine, and back boards between an inside cover fabric and an outside cover fabric to receive first and second spine panel spacers (which may also be called "shuttle inserts" herein). The binder cover 100 is positioned inside face downward, for example on a conveyor belt, with the spine panel in alignment with the shuttle inserts, which are disposed in a retracted state as shown in FIG. 11 to be described.

Figure 10A:
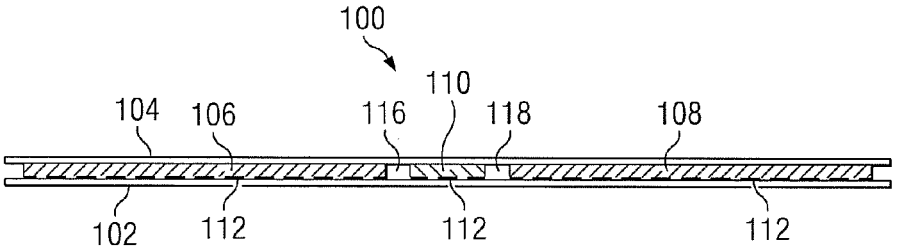
FIG. 10A depicts an edge view cross section of the step shown in FIG. 10 with the front, spine, and back boards positioned between an inside cover fabric and an outside cover fabric.

FIG. 10A depicts an edge view cross section of the step shown in FIG. 10. A back cover board 106, front cover board 108, and spine panel board 110 (also called the spine panel 110 herein) are disposed between the inside 102 and outside 104 cover fabrics. The cover boards 106, 108, and 110 may be retained in position on the inside cover fabric 102 using a coating of adhesive 112 as shown in FIG. 10A. In this example, the coating of adhesive 112 may be applied by a wiping device (not shown—it is not part of the invention) that dispenses a controlled amount of the adhesive 112 within specific designated areas of the respective cover board locations. Following the step of applying an adhesive to the inside cover fabric 102, the combined inside cover fabric 102, the cover boards 106, 108, 110, and the outside cover fabric 104 may be passed through a step to press these three "layers" together. This step facilitates an adequate bond of the cover boards to the outside cover fabric 104 layer and flattens and smoothes the outside cover fabric 104 against the cover boards so that the outside of the binder cover 100 does not have wrinkles in the cover fabric when a clear overlay is applied to the binder cover. Also shown in FIGS. 10 and 10A are first 116 and second 118 hinge locations—spaces between the proximate edges of the back cover board 106 and spine panel board 110 and the proximate edges of the front cover board 108 and the spine panel board 110 where the hinges of the binder cover 100 will be formed.

Figure 11:
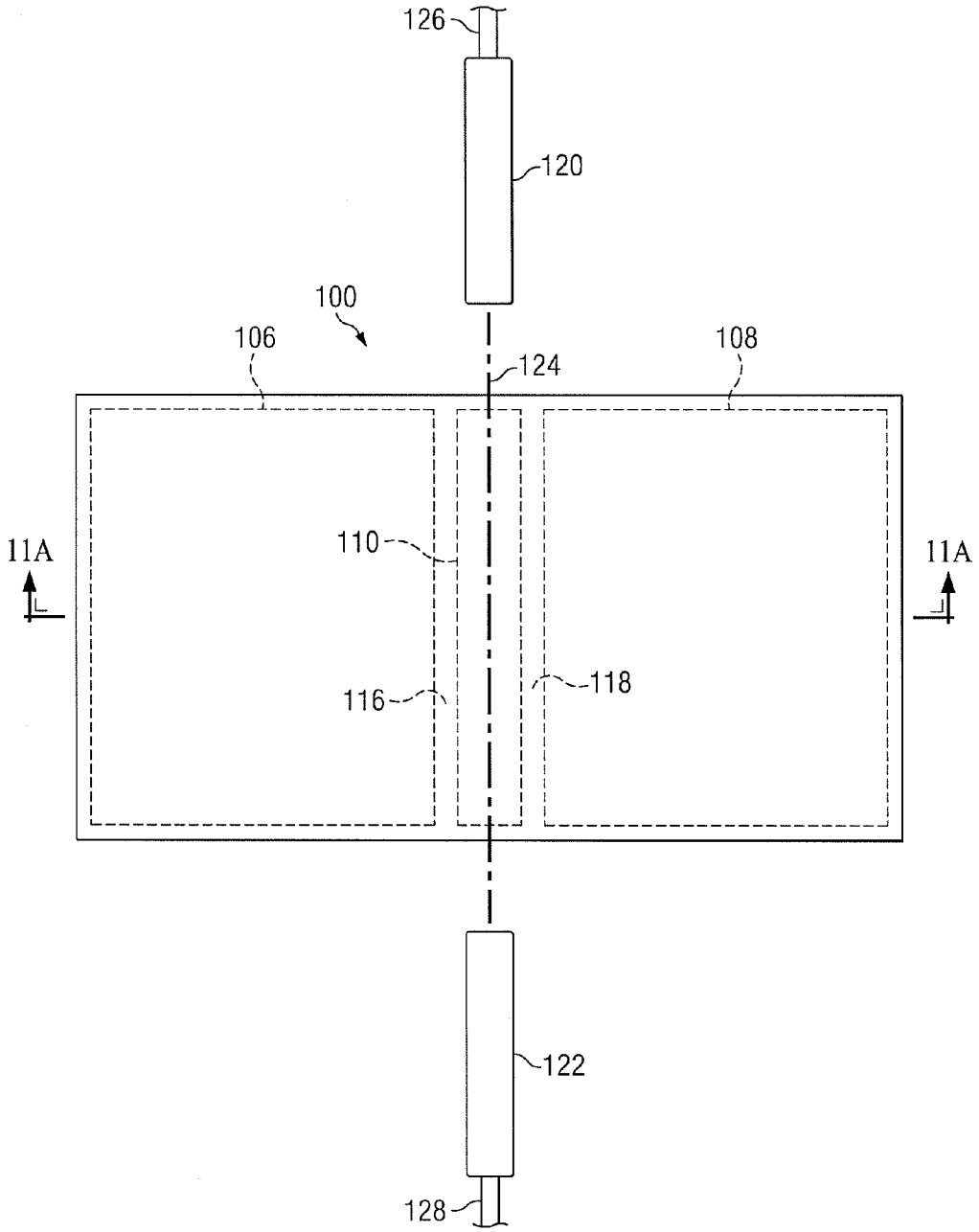
FIG. 11 depicts the step of advancing the assembly of FIG. 10A to position the spine panel of the binder cover in alignment with first and second spacer inserts.

FIG. 11 depicts the step of advancing the assembly of FIGS. 10 and 10A to position the spine panel 110 of the binder cover 100 in alignment with first 120 and second 122 spacers, which are supported by members 126 and 128 respectively. The first 120 and second 122 spacers, which may be fabricated of paper, plastic, wood, or a composite material, and having a thickness dimension of at least 0.50 mm and less than approximately 3.0 mm, are shown aligned with a centerline 124 along the longitudinal center of the spine panel 110.

Figure 11A:
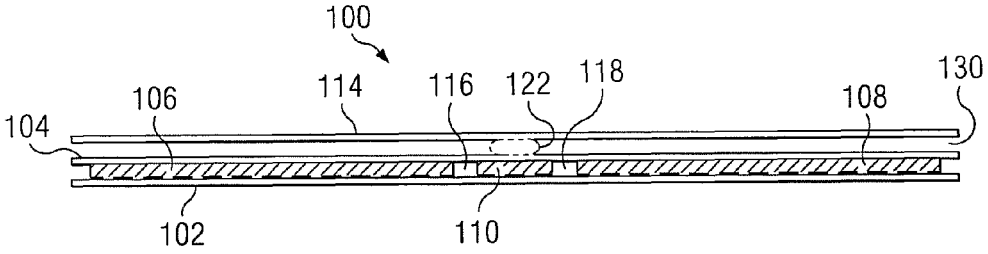
FIG. 11A depicts an edge view cross section of FIG. 11 following the step of positioning a clear overlay above the outside cover fabric.

FIG. 11A depicts an edge view cross section of FIG. 11 following the step of positioning a clear overlay 114 above the outside cover fabric 104 of the binder cover 100. In this edge view shown in a broken line identified with the reference number 122 is the intended position of the spacer inserts 120, 122 within the space 130 when they are extended from the side of the manufacturing process line as will be illustrated in FIG. 12 to be described. The space 130, depending on the particular mechanisms used to insert the spacer inserts 120, 122, may be set to whatever distance is appropriate. For example, the space 130 should be large enough to readily and consistently insert the spacer inserts 120, 122 between the clear overlay 114 and the binder cover 100. In some applications this spacing 130 may be of the order of approximately one to two centimeters. In other examples, this space may be up to approximately 5 (five) centimeters. In most cases, after the spacer inserts 120, 122 are withdrawn the spacing 130 may be relaxed to prepare for applying the fine line or temporary seals to the hinge locations as will be described.

Figure 12:
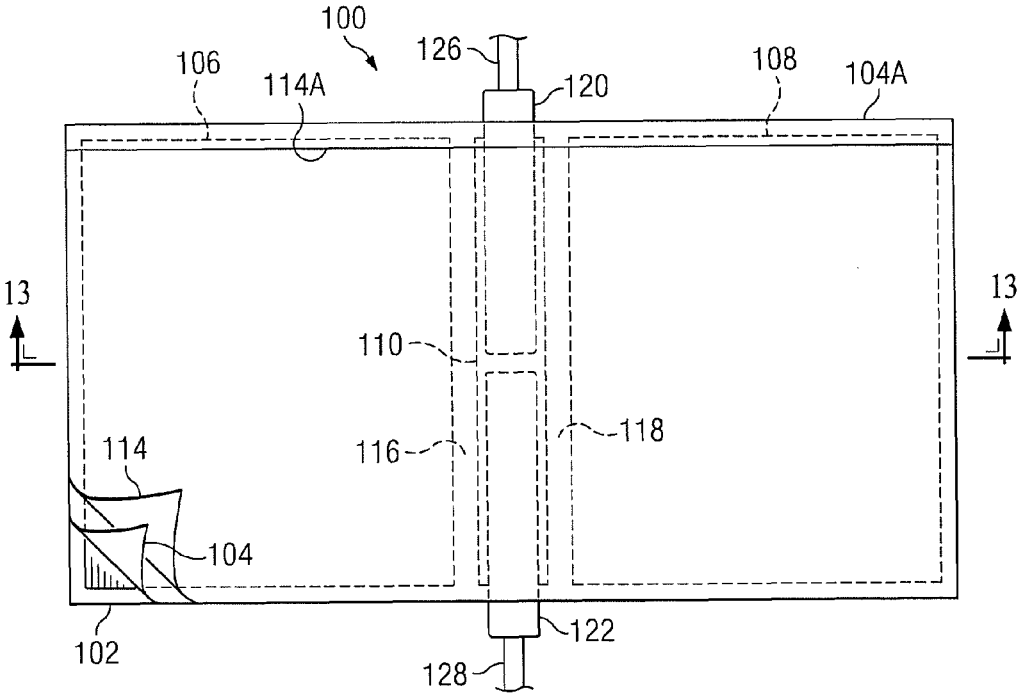
FIG. 12 depicts the step of inserting the first and second spacer inserts into the space above the spine panel and between the outside cover fabric of the binder cover and the clear overlay.

FIG. 12 illustrates the binder cover after the clear overlay 114 has been placed over and above the binder cover as described in FIG. 11A. It will be observed that the clear overlay 114 is positioned so that the entire length of its "upper" edge (that is, the edge 114A in the upper portion of FIG. 12) is spaced a short distance—typically about 0.50 to 1.0 cm—away from the adjacent upper edge 104A of the binder cover 100. This spacing is provided to enable labels to be inserted under the clear overlay of the first 106 and second 108 cover boards and the spine panel 110. FIG. 12 also depicts the step of inserting the first 120 and second 122 spacers into the space 130 above the spine panel and between the outside cover fabric 104 of the binder cover 100 and the clear overlay 114. Normally in a retracted position alongside the process line, the spacers 120, 122 may be extended automatically upon indexing the process line advancing mechanism at an appropriate time in alignment with the spine panel 110 between the first 116 and second 118 hinge locations.

Figure 13:
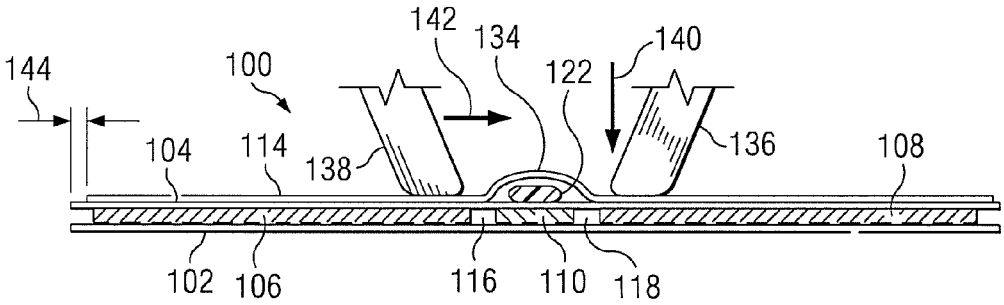
FIG. 13 depicts the step of nudging the clear overlay on one side of the binder cover toward the spine panel while holding the clear overlay in position above the other side of the binder cover to create a slight bulge of the clear overlay just above the spine panel.
Figure 14:
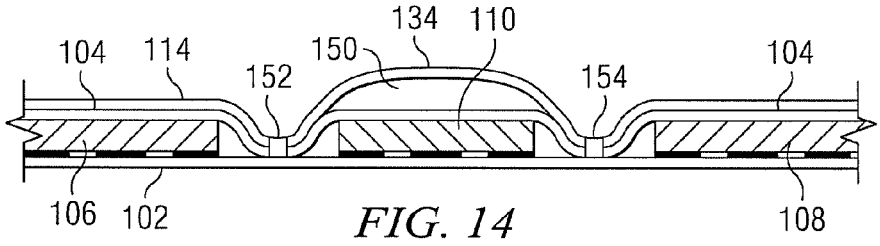
FIG. 14 depicts an enlarged edge view cross section of the binder cover following the step of applying a fine line seal along the first and second hinge locations and after the step of withdrawing the first and second spacer inserts.

FIG. 13 depicts, for purposes of illustration but not limitation, the step of nudging the clear overlay 114 on one side (shown here as the left side over the back cover board 106) of the binder cover 100 toward the spine panel 110 while holding the clear overlay 114 in position above the other side (shown here as the right side over the front cover board 108) of the binder cover 100 to create a slight bulge 134 of the clear overlay 114 just above the spine panel 110. In this view, spacer 120 is shown in position. The concept of the nudging step is illustrated by the first 136 and second 138 extenders. The first extender 136 holds the outside cover fabric 104 that covers the front binder cover 108 in position as the second extender 138 pushes against the left side of the outside binder cover 104 toward the spine panel 110 by a slight predetermined amount to create the bulge 134 in the clear overlay just above the spine panel 110, which creates a spine label pocket 150 as shown in FIG. 14 to be described. Following the nudging step the first 136 and second 138 extenders may be retracted to withdraw the spacers 120, 122 and await the next binder cover 100 to emerge from the preceding step into position for performing the nudging step on the next binder cover.

After the nudging step is performed, in FIG. 14 the binder cover 100 advances to a station that applies a fine line (or "tack") seal or seam (e.g., a temporary seal or seam) 152, 154 to tack bond the clear overlay 114 to the inside 102 and outside 104 cover fabrics to secure them together just before the first 120 and second 122 spacers are withdrawn from the spine label pocket 150. FIG. 14 depicts an enlarged edge view cross section of the binder cover 100 following the step of applying this fine line seal 152, 154 respectively along the first 116 and second 118 hinge locations and after the step of withdrawing the first 120 and second 122 spacers.

Figure 15:
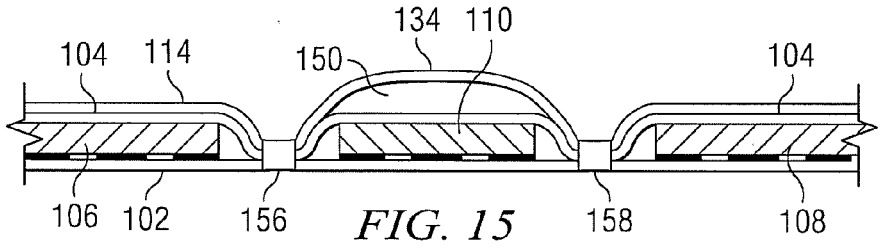
FIG. 15 depicts an enlarged edge view cross section of the binder cover following the step of applying a full width seal along the first and second hinge locations.
Figure 16:
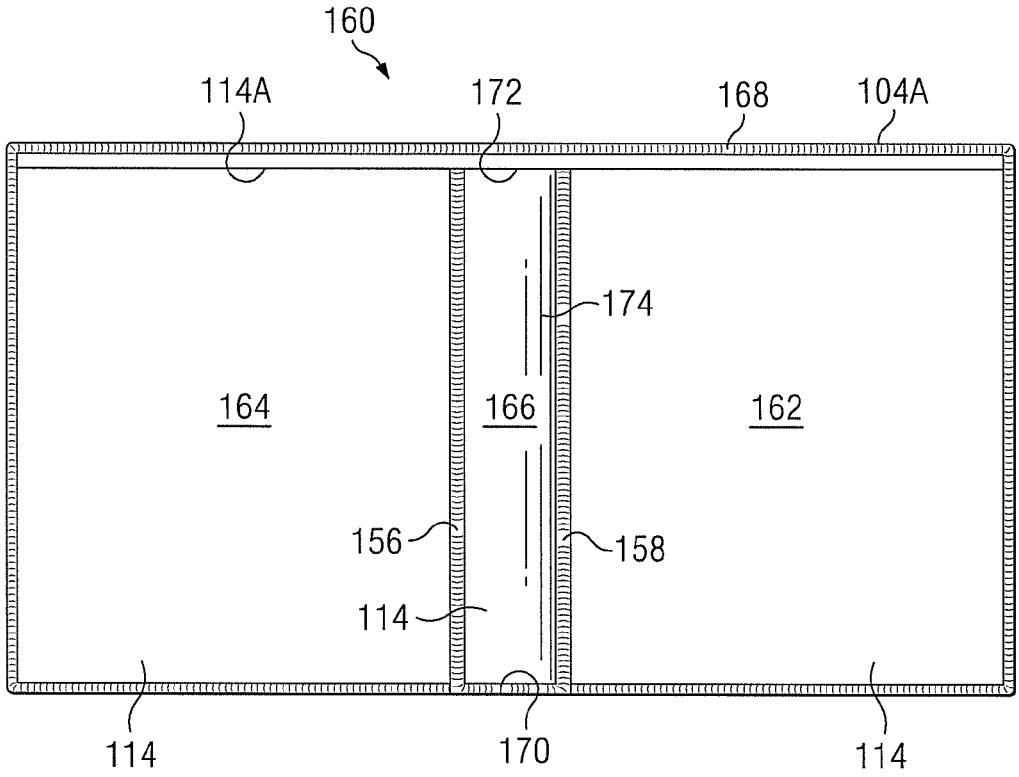
FIG. 16 depicts the binder cover following the step of applying a full width seal around the perimeter of the binder cover to seal the edges of the inside and outside covers and the clear overlay.

FIG. 15 depicts an enlarged edge view cross section of a portion of the binder cover 100 following the step of applying full width seals or seams (e.g., permanent or continuous seals or seams) 156, 158 along each of the first 116 and second 118 hinge locations depicted in FIGS. 10 through 13. FIG. 16 depicts the completed binder cover 160 following the step of applying a full width seal 168 around the perimeter of the binder cover to seal the edges of the inside 102 and outside 104 covers and the clear overlay 114 together. In a subsequent step any excess inside 102 and outside 104 cover fabric and clear overlay 114 that extends beyond the full width seal 168 at the edges of the binder cover 160 may be trimmed, for example, in a die cutting operation, resulting in the appearance of the completed binder cover 160 as shown in FIG. 16. In this view, the front side cover 162 and back side cover 164 are attached at the hinge locations 156, 158 to the spine panel 166. Disposed over the spine panel 166 is the spine label pocket 174. At the upper edge 104A of the binder cover 160 the clear overlay 114 is open at its upper edge 114A—i.e., it is not sealed along the full width seal 168 across the upper edge of the binder cover 160 to permit insertion of labels in the pocket spaces between the outside fabric of the binder cover 160 and the clear overlay, in the front 162 and back 164 side covers and spine panel 166. The spine panel 166 includes a spine label pocket 174 formed by the method described herein above. A label may be inserted into the spine label pocket 174 at its upper edge 172.

The embodiments described herein adapt the binder covers to improved function and save time, prevent damage to insert labels, and do not require additional tools to insert or remove labels. The illustrated embodiments provide for easy removal of the label allowing for the binder to be easily reused or its title changed. While the invention has been shown in only several of its forms, it is not thus limited but is susceptible to various changes and modifications without departing from the spirit thereof. For example, the binding cover of the present invention is readily adapted to covers for binding other forms of books including without limitation a loose-leaf binder, a ring binder, a document binder, a case-bound book, a case-bound document, a hard back book, a book cover, a scrapbook, an album, a photo album, and a bound portfolio. The invention applies to the cover boards or panels of the covers of the book or binder and the spine board or panel attached between them along hinged joints, and the particular configuration of the clear overlay in the three embodiments illustrated herein, in the region of the spine for inserting a label.

Methods for manufacturing the binder cover are also described, including a method suited for automating the production in a continuous process. It is a method that employs first and second spacers that may be extended from either side of the binder cover assembly as it proceeds along the process line to create space within a spine label pocket.

What is claimed is:

1. A method of providing a label pocket on a spine panel of a binder cover, comprising the steps of:

positioning a front cover, a spine panel, and a back cover boards of said binder cover between an inner covering sheet and an outer covering sheet with proximate edges of said boards separated by a predetermined hinge gap;

placing a transparent sheet overlay over said outer covering;

inserting, from each end of and aligned with said spine panel toward a midpoint thereof, a respective first and second spacer between said outer covering and an inner surface of said overlay;

applying a first and second temporary seam respectively along said first and second hinge gaps, such that said temporary seams partially bond said overlay and said outer and inner coverings together along said hinge gaps; and retracting said first and second spacers following said applying step.

2. The method of claim 1, wherein the step of positioning further comprises the step of:

applying an adhesive to portions of an inside surface of said outer covering sheet before said cover and spine panel boards are positioned in place on said inner cover sheet.

3. The method of claim 1, wherein the step of placing comprises the step of:

placing a transparent sheet overlay over said inner covering of said binder cover and urging one side of said overlay toward said spine panel thereby causing said overlay to bulge above said spine panel.

4. The method of claim 1, further comprising the step of:

applying a permanent seal along said first and second temporary seams after retracting said spacers.

5. The method of claim 4, further comprising the steps of:

trimming a narrow margin of said transparent overlay material from an upper border thereof to expose an upper edge of said binder cover and form an opening for inserting labels therein; and applying a continuous seal around all perimeter edges of said front cover, spine panel and back cover of said loose-leaf binder, thereby bonding corresponding edges of said transparent overlay and said inner and outer coverings together.

6. The method of claim 5, further comprising the step of:

trimming excess of said inner and outer covering and said overlay from the perimeter of said binder cover.

7. The method of claim 1, further including the step of:

forming said first and second spacers of metal to be substantially flat and narrower than the width of said spine panel.

8. The method of claim 7, further comprising the step of:

providing said first and second spacers having a thickness dimension of at least 0.50 mm.

9. The method of claim 7, further comprising the step of:

forming said spacers from a material selected from the group consisting of metal, plastic, cellulose-based material, and a composite material.

10. The method of claim 1, wherein the step of placing comprises:

providing for said transparent overlay a thin sheet of transparent polyvinyl chloride (PVC) or polypropylene (PP) having a thickness of at least 0.05 mm. and less than approximately 0.30 mm.

11. The method of claim 1, comprising the step of:

adapting said method to provide a spine label pocket for an article selected from the group consisting of a loose-leaf binder, a ring binder, a document binder, a case-bound book, a case-bound document, a hard back book, a book cover, a scrapbook, an album, a photo album, and a bound portfolio.

12. The method of claim 1, further comprising the step of:

providing said first and second spacer inserts having a thickness dimension of at least 0.50 mm and less than approximately 3.0 mm.

13. The method of claim 12, further comprising the step of:

forming said first and second spacer inserts from a material selected from the group consisting of paper, plastic, wood, and a composite material.

14. The method of claim 1, wherein the step of placing a transparent sheet comprises the step of:

providing a thin sheet of transparent polypropylene or polyvinyl chloride having a thickness of at least 0.05 mm and less than approximately 0.30 mm.

15. A method of forming a spine panel label pocket in a binder cover having a clear overlay covering the outer surfaces of said binder cover, comprising the steps of:

inserting retractable first and second shuttle inserts, one each from opposite top and bottom ends of a spine panel of said binder cover, between said spine panel and said overlay;

applying a temporary seal along first and second hinge lines disposed on either side of said spine panel, thereby tacking said overlay to said binder cover along said first and second hinges; and withdrawing said shuttle inserts from said binder cover.

16. The method of claim 15, further comprising the step of:

following said inserting step, nudging said overlay laterally from one side along said binder cover toward said spine panel to bulge said overlay slightly in region above said spine panel.

17. The method of claim 15, further comprising the step of:

preceding said inserting step, positioning said binder cover, inside face downward and said spine panel in alignment with said shuttle inserts disposed in a retracted state.

18. The method of claim 15, further comprising the step of:

following said withdrawing step, applying a permanent seal along said first and second hinge lines disposed on either side of said spine panel, thereby securing said overlay to said binder cover and forming a label pocket between said overlay and said spine panel.

19. The method of claim 18, further comprising the step of:

applying a full width seal along said bottom end of said spine panel.

* * * * *